US009435148B2

(12) United States Patent
Glickman et al.

(10) Patent No.: US 9,435,148 B2
(45) Date of Patent: Sep. 6, 2016

(54) LATCH SPRING MECHANISM

(71) Applicants: Joel I. Glickman, Jupiter, FL (US); Charles Rodgers, Langhorne, PA (US)

(72) Inventors: Joel I. Glickman, Jupiter, FL (US); Charles Rodgers, Langhorne, PA (US)

(73) Assignee: Rodon Limited Partnership, Hatfield, PA (US)

( * ) Notice: Subject to any disclaimer, the term of this patent is extended or adjusted under 35 U.S.C. 154(b) by 147 days.

(21) Appl. No.: 13/963,679

(22) Filed: Aug. 9, 2013

(65) Prior Publication Data

US 2015/0042107 A1 Feb. 12, 2015

(51) Int. Cl.

| | |
|---|---|
| ***E05C 1/10*** | (2006.01) |
| *E05C 1/04* | (2006.01) |
| *E05B 15/16* | (2006.01) |
| *E05B 15/04* | (2006.01) |
| *E05C 7/00* | (2006.01) |

(52) U.S. Cl.

CPC ..... *E05C 1/10* (2013.01); *E05B 15/1635* (2013.01); *E05B 2015/0451* (2013.01); *E05B 2015/0468* (2013.01); *E05C 2007/007* (2013.01); *Y10T 292/1014* (2015.04)

(58) Field of Classification Search

CPC ..... E05B 2015/0472; E05B 2015/0479; E05B 15/04; E05B 65/0864; E05B 65/087; E05B 65/0876; E05B 15/1635; E05B 2015/0451; E05B 2015/0468; E05C 1/004; E05C 1/10; E05C 1/08; E05C 1/085; E05C 2007/007; F16F 15/1211; F16F 15/1214; F16F 15/1331; F16F 15/1335; F16F 1/027; F16F 1/328; F16F 1/34

USPC ..... 292/137, 163, 175, 145–147, 150, 152, 292/DIG. 20, DIG. 38, DIG. 47, DIG. 61; 49/183–185; 267/164, 165

See application file for complete search history.

(56) References Cited

U.S. PATENT DOCUMENTS

| | | | | |
|---|---|---|---|---|
| 3,240,039 A * | 3/1966 | Baermann | ..... | 70/71 |
| 3,469,875 A * | 9/1969 | Ahlgren | ..... | 292/175 |
| 4,218,599 A * | 8/1980 | Garn | ..... | 200/530 |

(Continued)

FOREIGN PATENT DOCUMENTS

| | | |
|---|---|---|
| EP | 716029 A2 * | 6/1996 |
| EP | 1640284 A2 * | 3/2006 |

(Continued)

*Primary Examiner* — Alyson M Merlino

(74) *Attorney, Agent, or Firm* — St. Onge Steward Johnston & Reens LLC

(57) ABSTRACT

A latch bolt mechanism for tilting window sashes includes an actuating spring that is integrally molded of plastic material in one piece with the latch bolt. The spring has a transversely corrugated configuration, comprised of at least two transversely disposed wave-like spring sections. Each spring section includes a pair of oppositely oriented U-shaped sections having spaced apart semi-cylindrical portions at opposite sides joined by transverse connecting sections. In a relaxed configuration of the spring, the several connecting sections are substantially parallel to each other and are longitudinally spaced apart. In a compressed configuration of the spring the connecting elements lie at an angle to each other and the several semi-cylindrical portions are closely spaced or in contact providing for the required spring compression without excessively stressing the plastic material. Significant production economies are realized with the one-piece, molded construction of the latch bolt and spring.

4 Claims, 6 Drawing Sheets

(56) References Cited

U.S. PATENT DOCUMENTS

| | | | | |
|---|---|---|---|---|
| 4,927,124 | A * | 5/1990 | Spedding | B60G 11/00 267/149 |
| 5,121,951 | A | 6/1992 | Harbom et al. | |
| 5,139,291 | A | 8/1992 | Schultz | |
| 6,178,696 | B1 * | 1/2001 | Liang | 49/185 |
| RE37,916 | E | 12/2002 | Szapucki et al. | |
| 7,914,054 | B2 * | 3/2011 | Blake, III | 292/173 |
| 2010/0059653 | A1 * | 3/2010 | Chen | F16F 1/027 248/617 |

FOREIGN PATENT DOCUMENTS

| | | | | |
|---|---|---|---|---|
| FR | 2852051 | A1 * | 9/2004 | |
| MC | FR 2628717 | A1 * | 9/1989 | E05B 73/0023 |
| WO | WO 03018943 | A1 * | 3/2003 | |

* cited by examiner

LATCH SPRING MECHANISM

FIELD OF THE INVENTION

The invention relates to window latch mechanisms, and particularly to spring operated latch mechanisms for tiltable window sashes.

BACKGROUND OF THE INVENTION

Certain popular window styles are designed to accommodate inward tilting of a lower sash member about a pivot axis adjacent to a lower edge thereof. This allows for ventilation without raising the sash and also simplifies access to the outer surfaces of the glass pane(s) for cleaning etc. The tiltable sashes are provided with latch mechanisms, sometimes referred to as tilt latches, at opposite sides of the top sash rail, to provide releasable locking engagement of the sash rail with opposite sides of the window frame. The tilt latches include sliding bolts that are spring actuated toward their locking positions while providing for manual release for tilting of the sash.

A representative form of tilt latch of the above-described type is illustrated and described in the Schultz U.S. Pat. No. 5,139,291. The mechanism of the Schultz patent is made up of a plastic housing in which a plastic latch bolt is received for sliding movement between extended (locking) and retracted (release) positions. A metal actuating spring is provided, positioned between elements of the latch bolt and elements of the housing, to bias the latch bolt toward its extended or locking position while permitting temporary manual retraction to a release position in order to be able to pivot the sash to an open position.

While the latch mechanism of the Schultz patent can function satisfactorily, the use of a metal actuating spring creates unfavorable cost issues relating to the cost of the spring and the assembly cost involved in incorporating the spring into the assembled mechanism. Efforts have been made in the past to reduce this cost factor by combining the latch bolt and the actuating spring as a single part of molded plastic, with a plastic spring integrally molded as an extension of the latch bolt. Examples of such efforts are the Harbom et al U.S. Pat. No. 5,121,951 and the Szapucki et al US patent RE37,916, each of which illustrates a form of actuating spring, molded of plastic material, integrally with the latch bolt. Although the proposals of these patents were published many years ago (more than ten years in the case of RE37,916 and more than twenty years in the case of U.S. Pat. No. 5,121,951), no such latch bolt mechanisms are commercially available at this time, notwithstanding the significant manufacturing and assembly cost savings that could be realized by integrally molding the spring with the latch bolt. With previous designs the integrally molded spring elements were not suitable to the task required, and the integrated construction, notwithstanding its many advantages in the production and assembly phases, has not achieved commercial success.

SUMMARY OF THE INVENTION

In accordance with the present invention, an integrally molded latch bolt and spring member is provided which incorporates a novel and significantly improved configuration of the spring element which not only provides a desired spring action but is suitable for repetitive operation over a period of many years without breakage and without significant diminishment of its necessary elastic characteristics. In the new device the actuating spring is of a unique, transversely corrugated configuration comprised of a series of at least two transversely disposed and longitudinally propagated wave-like sections formed by alternately reversely oriented U-shaped spring sections open at one side and having semi-cylindrical closed portions at the opposite side. Preferably, the actuating spring has a ribbon-like shape, in which the height of the spring, in cross section, is several times its thickness. The legs of the U-shaped sections form connecting sections which join the transversely spaced apart semi-cylindrical portions at opposite sides of the spring. The connecting sections are disposed transversely of the longitudinal axis of the spring and in substantially parallel relation to each other. The semi-cylindrical portions are of relatively small radius, preferably between one-third and one-fourth of the overall amplitude of the wave-like sections, in order to optimize the number and shape of the wave forms that are contained within the confined space at the back of the latch housing.

In the mechanism of the invention, the U-shaped configuration of the spring sections enables the number of spring sections to be optimized to avoid excessive stresses on the spring material during retractions of the latch bolt while at the same time accommodating a full range of required compression of the latch spring during normal operations of the latch mechanism. The unique configuration of the spring enables the lateral excursions of a compressed spring to be effectively confined between the housing side walls without jamming or unnecessarily resisting the retracting motion of the latch bolt. Pursuant to the invention, the connecting sections of the spring are transversely disposed and substantially parallel when the spring is in its unstressed, extended condition. As the spring is compressed during retraction of the latch bolt, the connecting elements of the spring are reoriented to lie at an angle to the transverse, tending to reduce slightly the transverse width of the spring and thus enabling the transverse width of the unstressed spring to be optimized within the space provided by the housing side walls.

The integrated spring and latch bolt arrangement of the invention also enables the desired results to be achieved while retaining the overall shape and size of presently standardized latch bolt housings, such that the new mechanisms can be utilized in existing window production facilities and procedures and also be substituted for older mechanisms in replacement markets.

For a more complete understanding of the above and other features and advantages of the invention, reference should be made to the following detailed description of a preferred embodiment thereof and to the accompanying drawings.

DETAILED DESCRIPTION OF THE INVENTION

Figure 1:
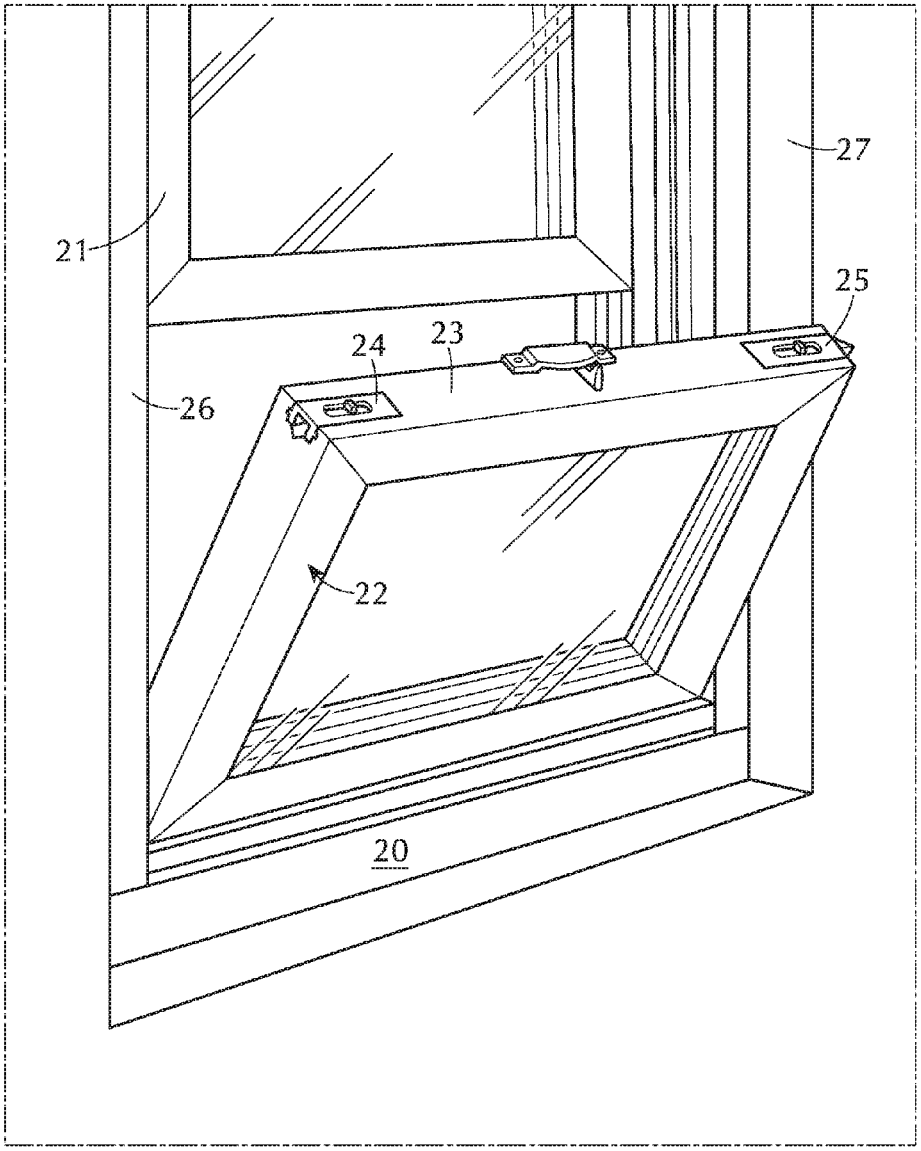
FIG. 1 is a front orthographic view of a typical window having a tiltable lower sash and incorporating tilt latch mechanisms.

Referring to the drawing, the reference numeral 20 (FIG. 1) designates a typical form of tilt sash window provided with upper and lower sashes 21, 22. As least the lower sash 22 is arranged to be tilted inward, as shown, for ventilation and to facilitate cleaning. The top sash rail 23 is provided with spring operated latch bolt mechanisms 24, 25 at opposite sides, which are arranged to engage the opposite side vertical frame rails 26, 27 to secure the sash 22 in a closed position.

Figure 2:
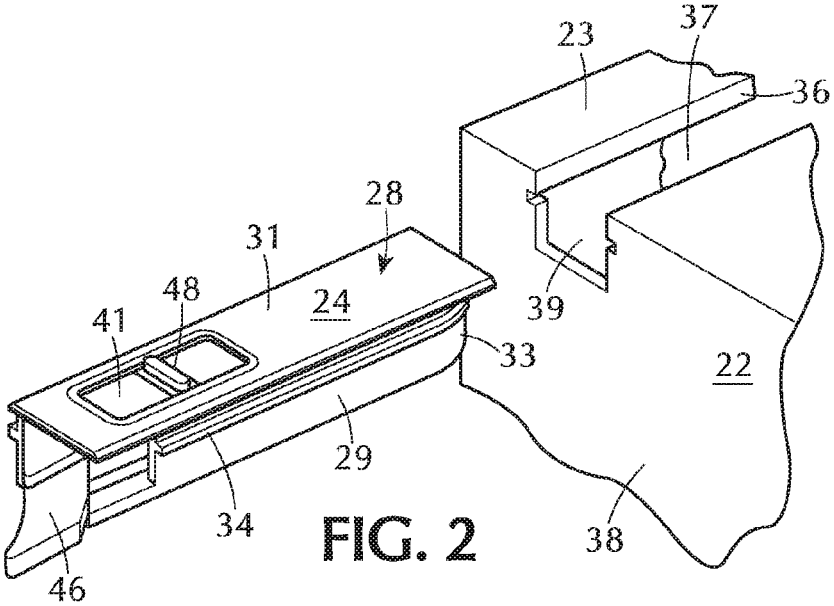
FIG. 2 is an exploded front orthographic view of a latch mechanism according to the invention, illustrating a typical manner in which it is installed in a window frame.
Figure 3:
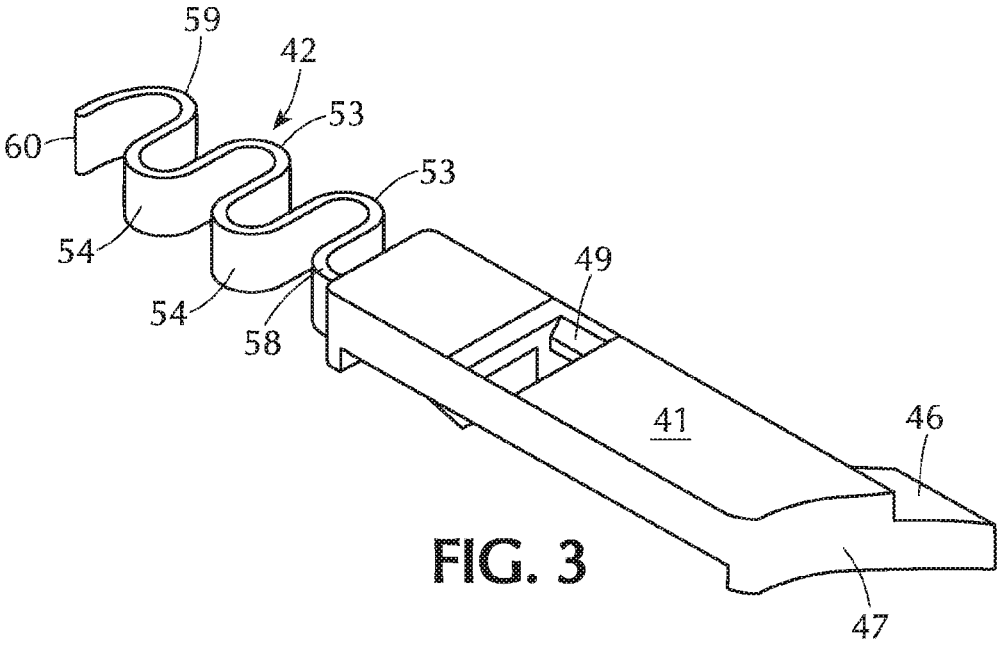
FIG. 3 is a front orthographic view from above of a integrally molded latch bolt and actuating spring according to the invention.
Figure 8:
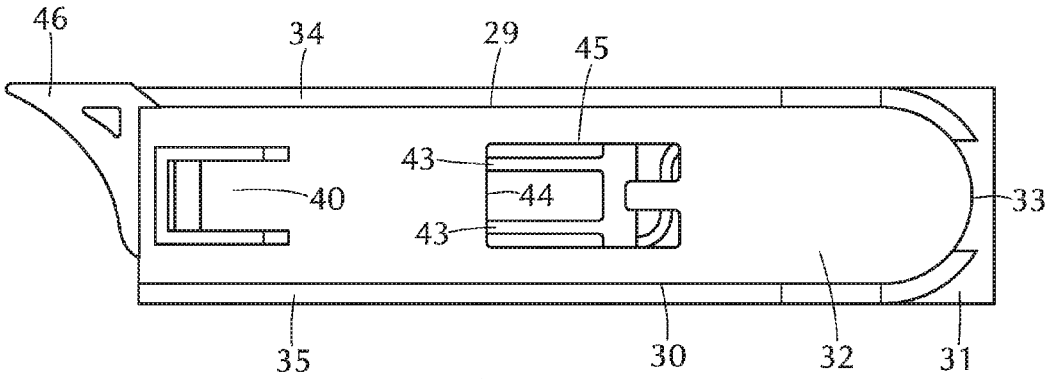
FIGS. 8 and 9 are bottom plan and elevational views, respectively, of the mechanism of FIG. 7.
Figure 9:
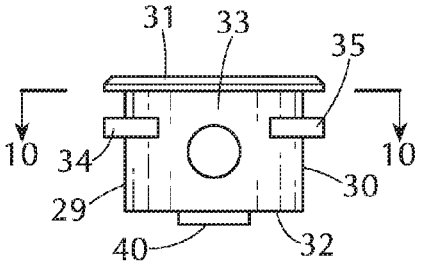

FIG. 2 illustrates the left side latch bolt mechanism 24 and the manner in which it is installed in the top rail 23 of the sash 22. The mechanism comprises an elongated housing 28, which is formed of spaced apart side walls 29, 30, top and bottom walls 31, 32, and a back wall 33. Positioning ribs 34, 35 extend along the side walls 29, 30, spaced a short distance below the under side of the top wall 31, equal to the thickness of the top panel 36 of the sash rail 23. The top panel 36 has a slot 37 formed therein to closely receive the housing 28. The top wall 31 overlies and is supported by the sash top panel 36. The positioning ribs 34, 35 closely underlie the panel 36 to secure the housing in the top panel. The side panel 38 of the sash, has a notch 39 formed therein shaped to closely receive the body of the housing 28 and the ribs 34, 35. On the underside of the housing, the bottom wall 32 is formed with a resiliently mounted locking tongue 40 (FIGS. 8, 9) which, when the housing 28 is fully inserted into the sash slots 37, 39, engages the inside of the sash panel 38, to lock the housing in assembled position in the sash 22.

Figure 6:
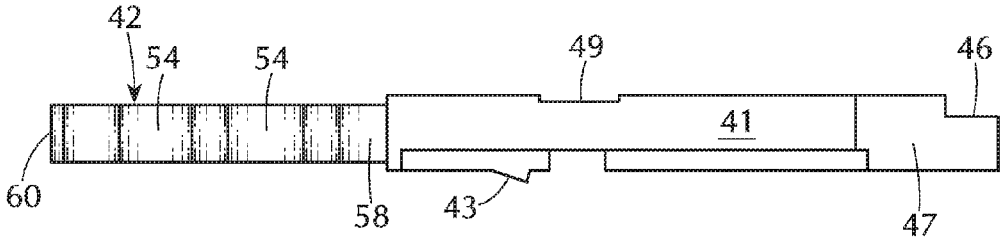
FIG. 6 is a side elevational view of the latch bolt and actuating spring of FIG. 3.
Figure 10:
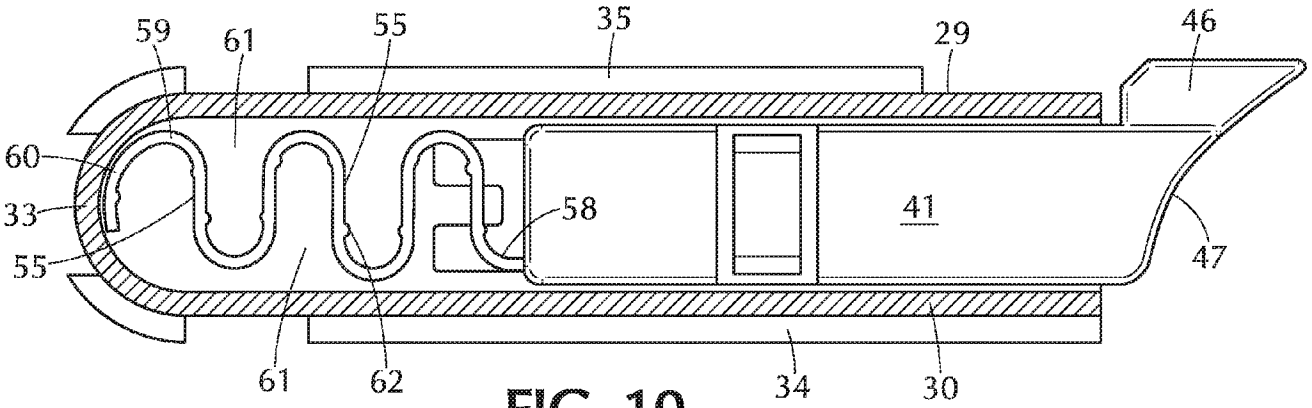
FIG. 10 is a cross-sectional view, as taken generally on line 10-10 of FIG. 9, illustrating the integrally molded bolt latch and spring, with the spring in an extended configuration.

A latch bolt 41 is received within the housing 28 and is resiliently urged by a spring 42, to be described, toward the open front end of the housing, to a fully extended limit position, as shown in FIGS. 2 and 10. This forward limit position is determined by locking tabs 43 (FIG. 6) projecting from the bottom of the latch bolt 41. The tabs 43 project through an opening 45 in the bottom wall 32 of the housing and engage a front edge 44 of that opening to limit the extending movement of the latch bolt. In the extended limit position of the latch bolt, a nose portion 46 thereof projects beyond the front of the housing and, when the sash 22 is pivoted to its closed position, enters recesses (not shown) in the window frame to lock the sash against opening, either by lifting of by pivoting. The nose portion 46 has an angular outwardly facing cam surface 47 which pushes the latch bolt to a retracted position during closing pivot movements of the sash 22, automatically locking the sash in a closed position. The bolt 41 must, however, be manually retracted in order to open the sash.

Figure 7:
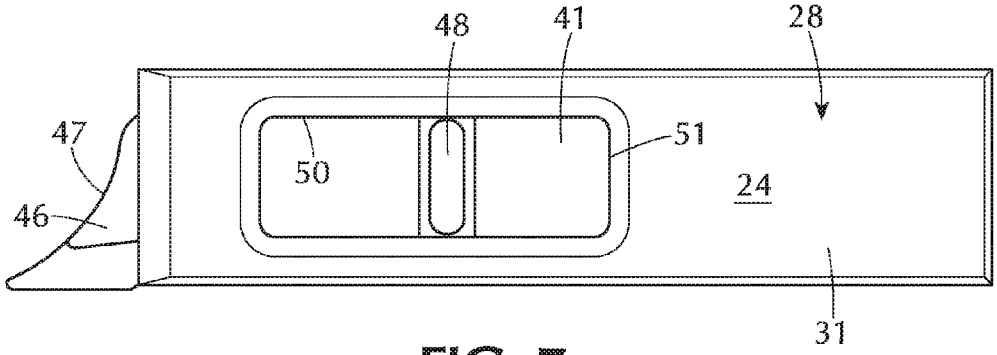
FIG. 7 is a top plan view of the tilt latch mechanism of the invention.

Manual retraction of the latch bolt is enabled by an upwardly projecting finger tab 48 (FIGS. 2, 7) which is received in a recess 49 in the top of the bolt and projects through an opening 50 in the top wall 31 of the housing. The back edge 51 of the opening serves as a limit stop for the finger tab 48 and thus determines a fully retracted limit position of the latch bolt 41.

The mechanism as described to this point is generally known and conventional from, for example, the before mentioned Schultz U.S. Pat. No. 5,139,291. However, whereas the latch bolt mechanism of the Schultz patent incorporates a compressible metal coil spring to bias the latch bolt, the mechanism of the invention incorporates a novel form of molded plastic spring 42, which is formed as an integral, one-piece molding with the latch bolt 41, enabling significant production savings to be realized by not only eliminating the metal coil spring of the Schultz mechanism, but also the cost of the procedures required to assemble the individual parts of the mechanism, including the spring as a separate element. The concept of an integrally molded latch bolt and spring has been attempted before, as reflected in the before mentioned Szapucki et al and Harbom et al patents. However, the previous attempts have been unsuccessful, because previously proposed integrated spring designs were not suitable for extended periods (i.e., many years) of repetitive use under the required conditions.

In accordance with an aspect of the invention, a novel and effective integrated plastic spring 42 is provided which is of a transversely corrugated configuration and comprises a plurality of at least two transversely disposed and longitudinally propagated wave-like spring sections 52. Each of the wave-like sections includes a pair of reversely oriented U-shaped sections, the closed ends of which are formed by transversely spaced apart arcuate sections 53, 54 of generally semi-cylindrical form. Extending between and joining the arcuate sections 53, 54 are connecting sections 55. The connecting sections are preferably straight sections although a limited contour may be incorporated into the connecting sections as long as there is no interference when the spring is compressed.

In the illustrated and preferred embodiment of the invention, the spring 42 is formed to have a generally flat, ribbon-like cross section of substantially greater height than thickness. In a practical embodiment of the invention, the height of the spring section may be 0.200 inch while its thickness may be 0.030 inch, and the cross section is substantially uniform throughout its length.

Figure 4:
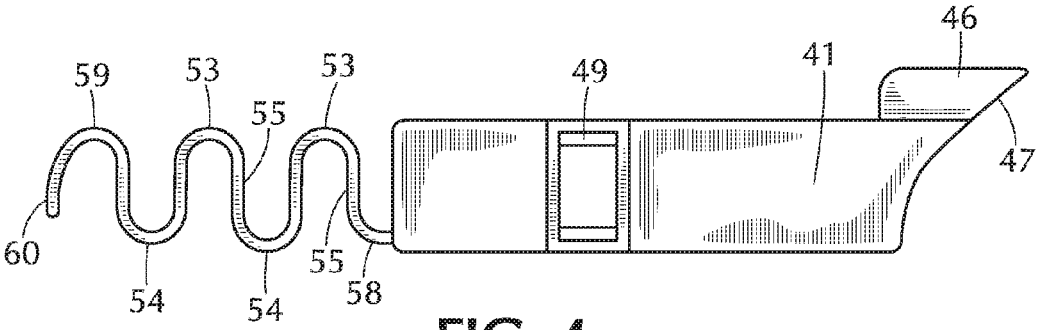
FIGS. 4 and 5 are top plan and bottom plan views, respectively, of the latch bolt and actuating spring of FIG. 3.
Figure 5:
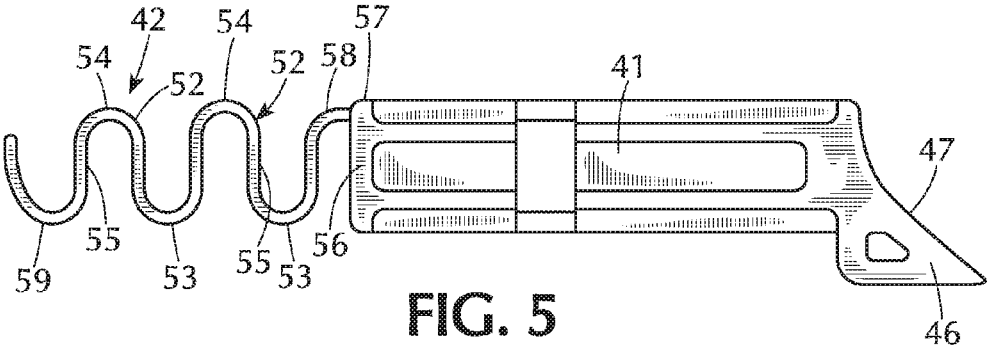

To particular advantage, and as a feature of the invention, the spring 42 is configured such that connecting sections 55, of which there are five in the illustrated embodiment, are disposed substantially at right angles to a longitudinal axis of the housing 28, and in parallel relation to each other, when the spring is in an extended, relaxed condition, as represented in FIGS. 4, 5 and 10. In addition, the semi-cylindrical arcuate sections 53, 54 have an outside radius which is relatively small in relation to the overall lateral width of the spring and preferably less than one-third of such lateral width. In a practical embodiment of the invention, the internal width of the housing 28 may be approximately 0.410 inch to closely receive and slideably guide a latch bolt 41 of approximately 0.405 inch in width. The amplitude of the wave-like spring sections 52 (which defines the lateral width of the spring) is approximately 0.380 inch, measured between outside surfaces of an opposed pair of arcuate sections 53, 54, or somewhat more than 90% of the width of the latch bolt and somewhat more than one-third of the extended length of the spring. The outside radius of the arcuate sections 53, 54 advantageously is approximately 0.1025 inch, which is less than one-third the overall width of the spring but preferably greater than one-fourth of such width.

In the illustrated and preferred embodiment of the invention, the forwardmost connecting element 55 is joined with the back end wall 56 of the latch bolt, preferably adjacent to one side wall 57 thereof, by an arcuate section 58 which extends over an angle of 90 degrees. The arcuate section 58 has an inside radius of about 0.098 inch, and serves to space the forwardmost connecting element away from the back of the latch bolt by that amount. The rearwardmost connecting element 55 is joined with an arcuate tail section 59, which preferably extends over an arc of at least about 180 degrees and is contoured on its end portion 60 to conform generally to the internal contours of the semi-cylindrical housing end wall 33 (see FIGS. 10, 11). The overall length of the extended, relaxed spring 42, in the illustrated embodiment is 1.052 inches, which corresponds substantially with the length of the housing cavity behind the latch bolt 41, when the latch bolt is in an extended limit position, as shown in FIG. 10. The extended spring thus serves to maintain the bolt in its extended limit position in the absence of any external longitudinal force on the bolt.

In the illustrated practical example of the invention, the latch bolt 41 has a range of longitudinal motion, between its fully extended and fully retracted positions, of approximately 0.430 inch. Accordingly, when the latch bolt is fully retracted, the spring 42 is compressed from an extended length of 1.052 inch to a compressed length of 0.620 inch, or slightly less than 60% of the extended length. In the extended form of the spring, illustrated in FIG. 10, the space 61 between adjacent parallel connecting sections 55 is approximately 0.145 inch, corresponding to an inside diameter of the semi-cylindrical sections 53, 54. This corresponds to somewhat less than 15% of the extended length of the spring.

Figure 11:
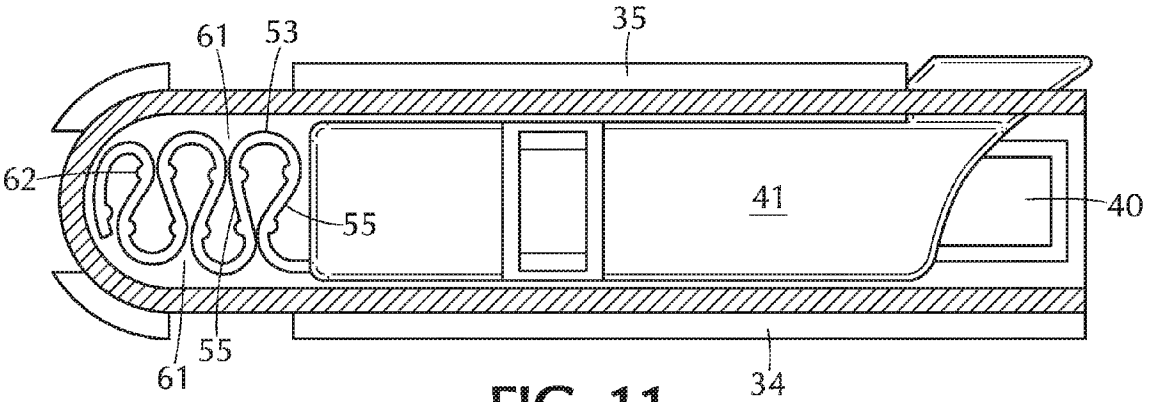
FIG. 11 is a cross-sectional view, similar to FIG. 10, illustrating the actuating spring in a compressed configuration.

In the compressed form of the spring, illustrated in FIG. 11, the spaces 61 collapse longitudinally until the arcuate sections 53, 54, 58, and 59 are very close together and in some cases actually touching each other, and the forwardmost arcuate section 53 is close to the end wall 56 of the latch bolt 41. The several connecting sections 55, in the compressed configuration, are no longer parallel, but are disposed at an angle to the transverse and to each other. Significantly, when the connecting sections 55 are repositioned from a substantially parallel, transverse orientation to an angular orientation, during compression of the spring, the angular orientation tends to narrow the width of the spring slightly. When the spring 42 is compressed, the U-shaped portions thereof may shift laterally under the compressive forces, but are closely confined by the side walls 29, 30 of the housing. The angular orientation of the connecting sections 55, by tending to slightly narrow the width of the spring, minimizes any frictional or other engagement between the housing side walls and the arcuate sections 53, 54 at opposite sides of the spring, and thus assures that manual retraction of the latch bolt may accomplished without jamming or excessive and non-uniform resistance.

In a preferred embodiment of the invention, the integrated latch bolt-spring is a unitary injection molding of an engineering grade plastic material. A preferred material is CELCON® acetal copolymer, available from Ticona, Summit, N.J. To facilitate ejection of the product from the molding machine, it is convenient to form small lands 62 (FIGS. 10, 11) at several locations over the length of the spring for engagement by ejection pins. The lands 62 are otherwise non-functional and preferably are confined to a region near one edge portion of the spring.

The configuration of the spring according to the invention includes at least two transverse wave-like sections, each including a pair of oppositely oriented U-shaped portions having longitudinally spaced apart connecting sections 55, extending transversely and in substantially parallel relation to each other. This configuration avoids imposing excessive stresses on the spring at any location during compression of the spring. As is evident in FIG. 11, in the compressed condition of the spring, the several connecting sections 55 are disposed at a relatively small angle of, preferably, less than 15 degrees from a perpendicular to the longitudinal axis. The semi-cylindrical sections 53, 54 are thus not excessively stressed, and the stress is well distributed over the length of the arc. Accordingly, even though the spring is necessarily confined within the back of the housing, to a space of relatively small length in relation to the extent of the required compression of the spring, the new configuration of the spring avoids excessive stressing of the spring material and assures the necessary operational life of the spring over many years and many compression cycles. In this respect, there are times when a sash may be oriented in a just slightly open position, in which the latch bolt is held in a retracted position by the window frame, and the spring thus held continuously in a compressed condition, for long periods of time. Were the spring to be excessively stressed in any section thereof for extended periods, it soon could take a set and lose its effectiveness. The spring configuration according to the invention avoids such overstressing and enables a practical and fully operational, long-life latch bolt-spring combination to be formed as a unitary molding of plastic material.

The latch bolt mechanism of the invention significantly reduces production costs by eliminating the spring as a separate part and also by eliminating the assembly operations required to install a spring into the completed mechanism. At the same time, the uniquely configured integrally molded spring incorporated into the new mechanism enables the spring to perform its function over the required extended lifetime without loss of effect from fatigue, creep or the like.

It should be understood, of course, that the specific embodiment of the invention herein illustrated and disclosed is intended to be representative only, as certain changes may be made therein without departing from the clear teachings of the invention. Accordingly, reference should be made to the following appended claims in determining the full scope of the invention.

What is claimed is:

1. A latch bolt mechanism for a window sash which is movable with respect to a window frame, said latch bolt mechanism comprising:

an elongated housing having top, bottom, side and back walls and being open at a front end, an integrated, one-piece latch bolt and actuating spring formed of a plastic material received within said housing, said latch bolt having front and back ends and spaced apart sides and being of a width to be closely received between the side walls of said housing and slideably guided thereby for movement on a longitudinal axis in said housing over a predetermined distance between a fully extended limit position and a fully retracted limit position, said actuating spring being integrally joined, at a front end thereof, with said back end of said latch bolt as a one-piece molding and extending longitudinally rearward from said latch bolt, said actuating spring having an extended condition and a compressed condition, when said latch bolt is in said fully extended and fully retracted limit positions, respectively, a back end of said actuating spring, when said latch bolt is in said fully extended limit position, extending to said housing back wall to retain said latch bolt in said fully extended limit position, said actuating spring comprising a series wave-shaped sections, each formed of alternately reversely oriented U-shaped sections open at one side and having a semi-cylindrical portion at an opposite side, each of said semi-cylindrical portions being joined to an adjacent one of said semi-cylindrical portions by an integrally molded connecting section disposed transversely to said longitudinal axis, forming legs of said U-shaped sections, wherein adjacent connecting sections are disposed in substantially parallel relation to each other when said actuating spring is in said extended condition, each of said wave-shaped sections having an amplitude, measured between laterally outermost surfaces of adjacent semi-cylindrical portions, such that, when said actuating spring is in said compressed condition, said wave-shaped sections are laterally confined by the housing side walls, said semi-cylindrical portions each having an outside radius which is less than one-third of said amplitude and greater than one-fourth of said amplitude, a forwardmost connecting section of said connecting sections is positioned closest to the back end of said latch bolt, being integrally joined with said back end, closely adjacent to one of the side walls of said latch bolt, by an arcuate spring section extending laterally and forwardly from an end of said forwardmost connecting section to space said forwardmost connecting section rearwardly from the back end of said bolt latch, a rearwardmost connecting section of said connecting sections is positioned closest to the back wall of said housing, being integrally joined with an arcuately shaped resilient tail section forming the back end of said actuating spring, said resilient tail section extending rearwardly over an arc of about 180° from said rearwardmost connecting section and having a portion positioned for contact with the housing back wall, said actuating spring having an extended length when the actuating spring is in said extended condition and a compressed length when the actuating spring is in said compressed condition, wherein said compressed length is less than 60% of said extended length, and a spacing between adjacent ones of said connecting sections, when said actuating spring is in said extended condition, is less than 15% of the extended length.

2. A latch bolt mechanism according to claim 1, wherein said connecting sections of said actuating spring consist of five uniformly spaced apart connecting sections.

3. A latch bolt mechanism according to claim 1, wherein the extended length of said actuating spring is approximately 1.052 inch, the compressed length of said actuating spring is approximately 0.620 inch, and said amplitude is approximately 0.380 inch.

4. A latch bolt mechanism according to claim 1, wherein said plastic material of which said actuating spring and said latch bolt are formed is an acetal copolymer.

* * * * *